US009266226B2

(12) United States Patent
Timmons

(10) Patent No.: US 9,266,226 B2
(45) Date of Patent: Feb. 23, 2016

(54) IMPACT TOOL

(71) Applicant: Milwaukee Electric Tool Corporation, Brookfield, WI (US)

(72) Inventor: Terry Timmons, Waukesha, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 452 days.

(21) Appl. No.: 13/782,905

(22) Filed: Mar. 1, 2013

(65) Prior Publication Data

US 2013/0228354 A1 Sep. 5, 2013

Related U.S. Application Data

(60) Provisional application No. 61/606,659, filed on Mar. 5, 2012, provisional application No. 61/611,642, filed on Mar. 16, 2012.

(51) Int. Cl.

| | |
|---|---|
| ***B25B 21/02*** | (2006.01) |
| ***B25B 23/00*** | (2006.01) |
| ***B25B 21/00*** | (2006.01) |

(52) U.S. Cl.

CPC ..... *B25B 21/02* (2013.01); *B25B 21/004* (2013.01); *B25B 21/026* (2013.01); *B25B 23/00* (2013.01)

(58) Field of Classification Search

CPC .... B25B 21/004; B25B 21/02; B25B 23/1405
USPC ..... 173/93, 93.5
See application file for complete search history.

(56) References Cited

U.S. PATENT DOCUMENTS

| | | | | |
|---|---|---|---|---|
| 3,939,924 | A * | 2/1976 | Grabovac | B25B 23/1427 173/216 |
| 4,821,611 | A | 4/1989 | Izumisawa | |
| 6,006,634 | A | 12/1999 | Byers | |
| 6,035,745 | A | 3/2000 | Kather | |
| 6,568,298 | B1 * | 5/2003 | Zinck | B25B 13/465 81/57.13 |
| 7,082,860 | B2 * | 8/2006 | Shu-Sui | B25B 13/465 81/60 |
| 7,255,029 | B2 | 8/2007 | Rastegar et al. | |
| 7,410,007 | B2 | 8/2008 | Chung et al. | |
| 7,455,574 | B2 | 11/2008 | Chu et al. | |
| 7,806,198 | B2 | 10/2010 | Puzio | |
| 7,963,195 | B2 | 6/2011 | McRoberts et al. | |
| 8,122,971 | B2 | 2/2012 | Whitmire et al. | |
| 8,146,676 | B2 | 4/2012 | Zhang et al. | |
| 8,172,713 | B2 | 5/2012 | Nakamura | |
| 8,631,880 | B2 * | 1/2014 | Murthy | B25B 21/023 173/109 |
| 9,016,395 | B2 * | 4/2015 | Scott | B25B 21/026 173/109 |

(Continued)

*Primary Examiner* — Thanh Truong
*Assistant Examiner* — Patrick Fry
(74) *Attorney, Agent, or Firm* — Michael Best & Friedrich LLP

(57) ABSTRACT

An impact tool includes a housing, a motor having an output shaft defining a first axis, a drive shaft rotatably supported by the housing about a second axis oriented substantially normal to the first axis, and an impact mechanism coupled between the motor and the drive shaft and operable to impart a striking rotational force to the drive shaft. The impact mechanism includes an anvil rotatably supported by the housing and coupled to the drive shaft, and a hammer coupled to the motor to receive torque from the motor and impart the striking rotational force to the anvil. The impact tool also includes a ratcheting mechanism operable to prevent rotation of the anvil and the drive shaft in a selected direction relative to the housing.

22 Claims, 6 Drawing Sheets

(56) References Cited

U.S. PATENT DOCUMENTS

2005/0279519 A1* 12/2005 Clark ..... B25B 21/026 173/216
2010/0000750 A1 1/2010 Andel
2010/0064864 A1 3/2010 Kobayashi
2010/0071923 A1 3/2010 Rudolph et al.
2010/0101815 A1 4/2010 Kobayashi
2011/0139474 A1* 6/2011 Seith ..... B23P 15/14 173/93
2012/0118596 A1* 5/2012 Scott ..... B25B 21/026 173/98
2013/0233585 A1* 9/2013 Lin ..... B25F 5/005 173/216

* cited by examiner

IMPACT TOOL

CROSS-REFERENCE TO RELATED APPLICATIONS

This application claims priority to U.S. Provisional Patent Application Nos. 61/606,659 filed Mar. 5, 2012 and 61/611,642 filed Mar. 16, 2012, the entire contents of both of which are incorporated herein by reference.

FIELD OF THE INVENTION

The present invention relates to power tools, and more particularly to impact tools.

BACKGROUND OF THE INVENTION

Impact tools or wrenches are typically used for imparting a striking rotational force, or intermittent applications of torque, to a workpiece. For example, impact wrenches are typically used to loosen or remove stuck fasteners (e.g., an automobile lug nut on an axle stud) that are otherwise not removable or very difficult to remove using hand tools.

SUMMARY OF THE INVENTION

The invention provides, in one aspect, an impact tool including a housing, a motor having an output shaft defining a first axis, a drive shaft rotatably supported by the housing about a second axis oriented substantially normal to the first axis, and an impact mechanism coupled between the motor and the drive shaft and operable to impart a striking rotational force to the drive shaft. The impact mechanism includes an anvil rotatably supported by the housing and coupled to the drive shaft, and a hammer coupled to the motor to receive torque from the motor and impart the striking rotational force to the anvil. The impact tool also includes a locking mechanism operable to selectively lock the anvil and the drive shaft relative to the housing.

The invention provides, in another aspect, an impact tool including a housing, a motor having an output shaft defining a first axis, a drive shaft rotatably supported by the housing about a second axis oriented substantially normal to the first axis, and an impact mechanism coupled between the motor and the drive shaft and operable to impart a striking rotational force to the drive shaft. The impact mechanism includes an anvil rotatably supported by the housing and coupled to the drive shaft, and a hammer coupled to the motor to receive torque from the motor and impart the striking rotational force to the anvil. The impact tool also includes a ratcheting mechanism operable to prevent rotation of the anvil and the drive shaft in a selected direction relative to the housing.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
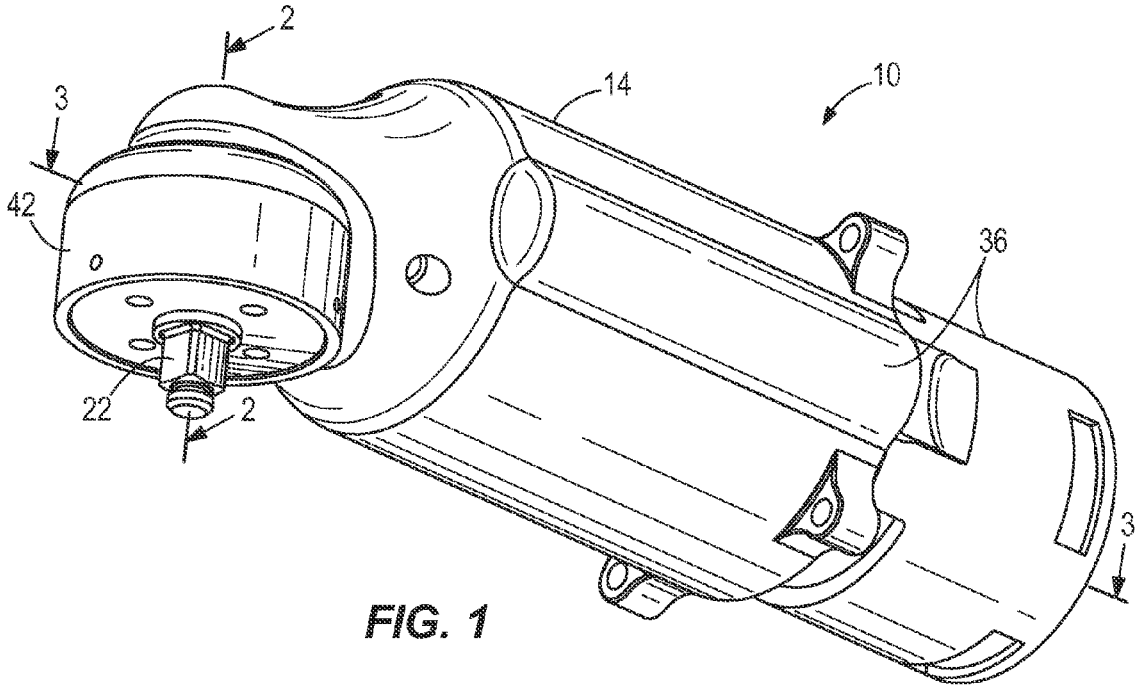
FIG. 1 is a front perspective view of an impact tool in accordance with an embodiment of the invention.
Figure 2:
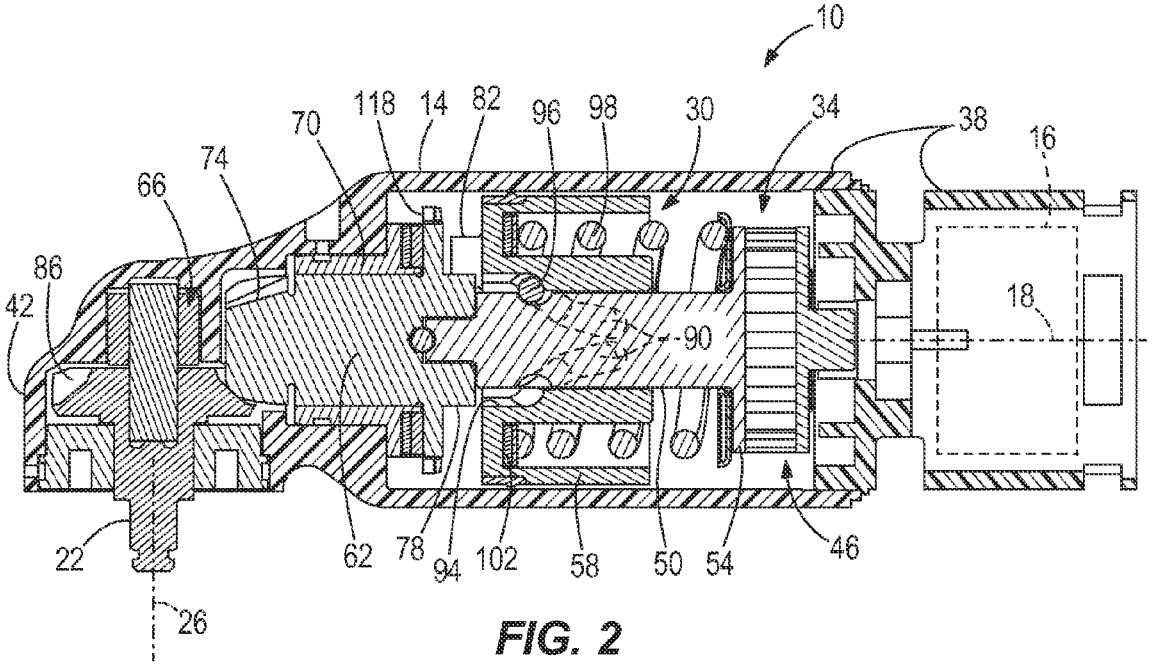
FIG. 2 is a cross-sectional view of the impact tool of FIG. 1.

With reference to FIGS. 1 and 2, an impact tool 10 in accordance with an embodiment of the invention includes a housing 14, a motor 16 having an output shaft (not shown) defining a first axis 18, a drive shaft 22 rotatably supported by the housing 14 about a second axis 26, which is oriented substantially normal to the first axis 18, and an impact mechanism 30 (FIGS. 2 and 3) coupled between the motor 16 and the drive shaft 22 and operable to impart a striking rotational force to the drive shaft 22. The impact tool 10 also includes a transmission 34 operably coupled to the motor 16 and the impact mechanism 30 for transferring torque from the motor 16 to the impact mechanism 30.

With reference to FIGS. 1 and 2, the housing 14 includes a motor support portion 38 extending along the first axis 18 in which the motor 16 is contained, and a head portion 42 in which the drive shaft 22 is rotatably supported. The motor support portion 38 is elongated and is grasped by the user of the tool 10 during operation. Although not shown, the impact tool 10 may include a battery pack electrically connected to the motor 16 via a trigger switch (also not shown) to provide power to the motor 16. Such a battery pack may be a 12-volt power tool battery pack that includes three lithium-ion battery cells. Alternatively, the battery pack may include fewer or more battery cells to yield any of a number of different output voltages (e.g., 14.4 volts, 18 volts, etc.). Additionally or alternatively, the battery cells may include chemistries other than lithium-ion such as, for example, nickel cadmium, nickel metal-hydride, or the like. Alternatively, the tool 10 may include an electrical cord for connecting the motor 16 to a remote electrical source (e.g., a wall outlet).

Figure 3:
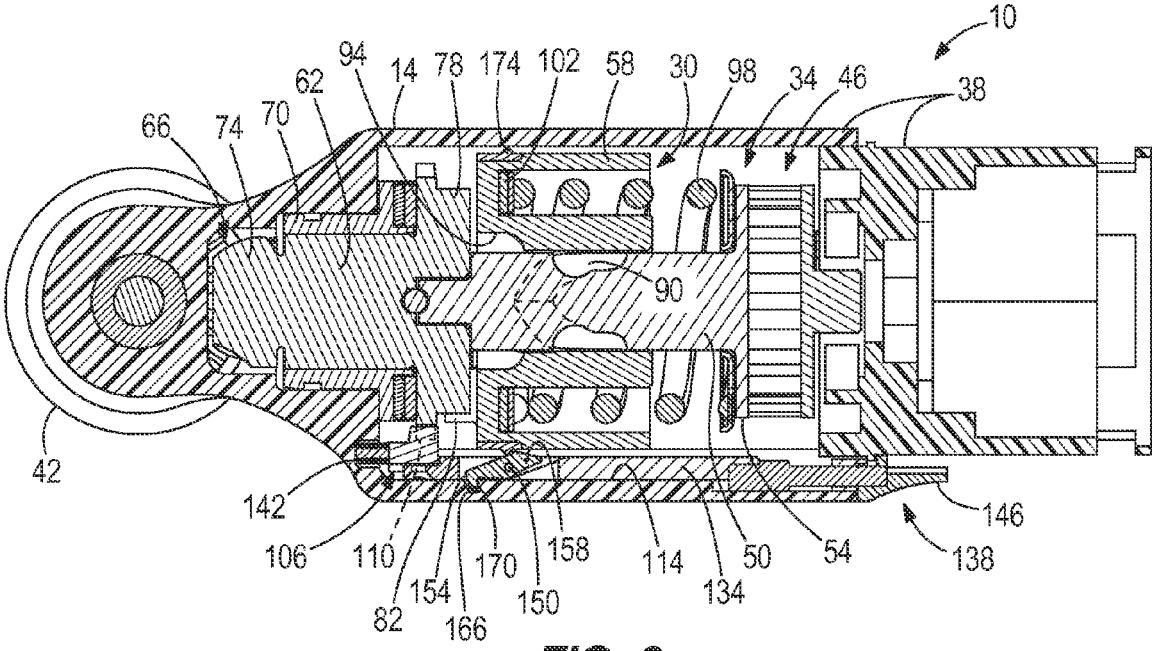
FIG. 3 is a cross-sectional view of the impact tool of FIG. 1 through a reference plane oriented perpendicular to that of FIG. 2.

With reference to FIGS. 2 and 3, the transmission 34 includes a single stage planetary transmission 46 and a transmission output shaft 50 functioning as the rotational output of the transmission 34. The planetary transmission 34 includes an outer ring gear (not shown), a carrier 54 rotatable about the first axis 18, and planet gears (also not shown) rotatably coupled to the carrier 54 about respective axes radially spaced from the first axis 18. In the illustrated embodiment of the transmission 34, the transmission output shaft 50 is integrally formed with the carrier 54 as a single piece. Alternatively, the transmission output shaft 50 may be a separate component from the carrier 54. The outer ring gear includes radially inwardly-extending teeth that are engageable by corresponding teeth on the planet gears. The outer ring gear is rotationally fixed to the housing 14.

Figure 4:
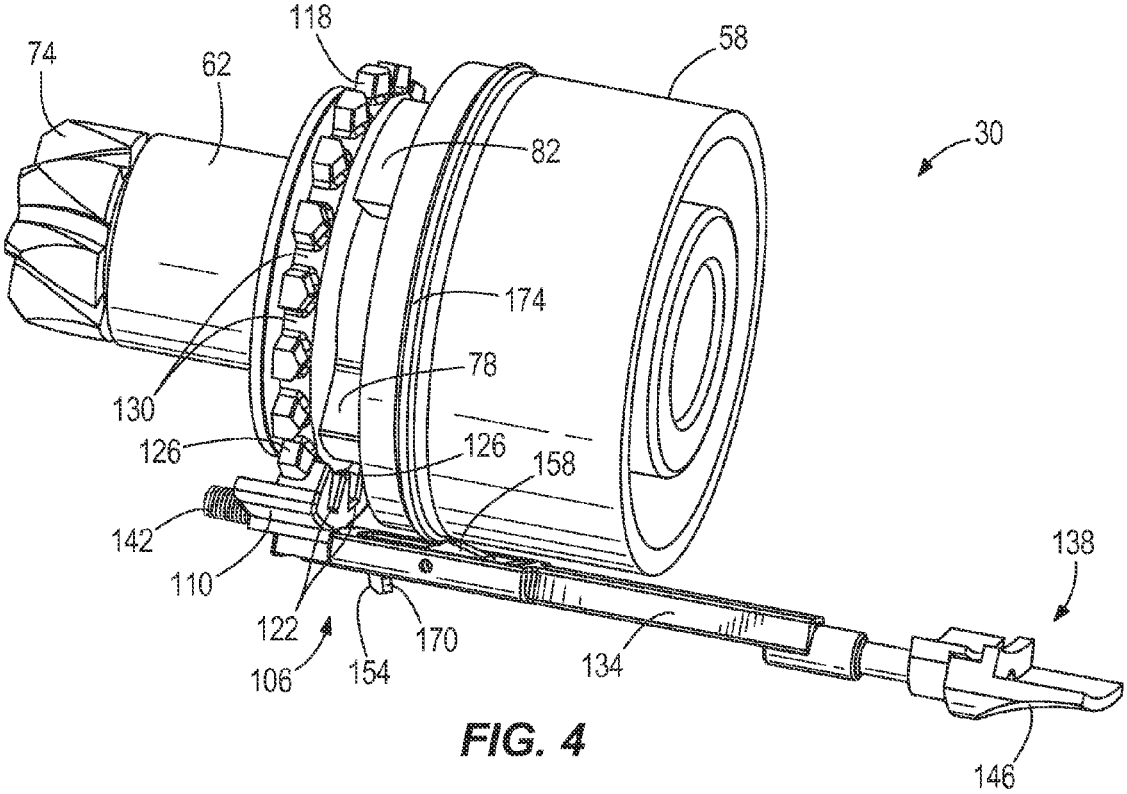
FIG. 4 is a rear perspective view of a portion of the impact tool of FIG. 1, illustrating an anvil, a hammer, and a locking mechanism for selectively locking the anvil to a housing of the impact tool.
Figure 5:
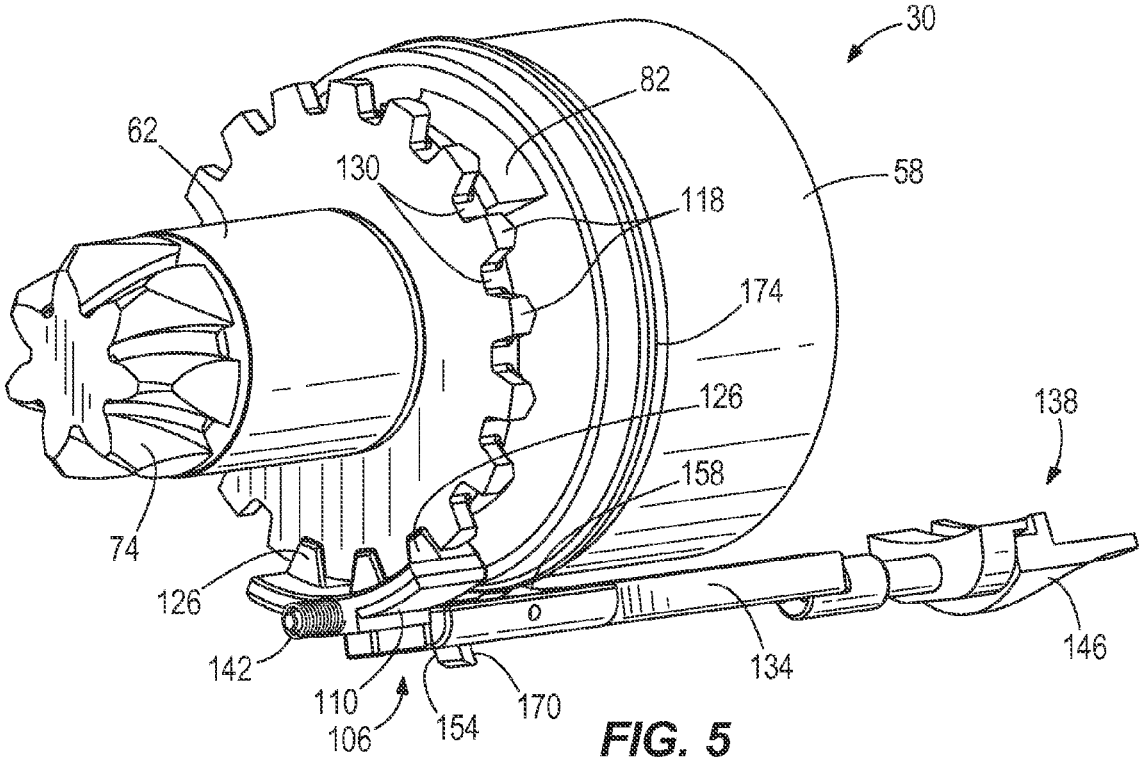
FIG. 5 is a front perspective view of the portion of the impact tool of FIG. 4.

With reference to FIGS. 2-5, the impact mechanism 30 includes a hammer 58 supported on the transmission output shaft 50 for rotation with the shaft 50, and an anvil 62 coupled for co-rotation with the drive shaft 22 via a gear train 66. The anvil 62 is supported for rotation within the housing 14 by a bushing 70. Alternatively, a roller bearing may be utilized in place of the bushing 70. In the illustrated embodiment of the tool 10, the anvil 62 is integrally formed with a pinion 74 or a first gear of the gear train 66 and includes opposed, radially outwardly extending lugs 78 (FIG. 6) that are engaged with corresponding lugs 82 on the hammer 58 (FIG. 5). The pinion 74 is engaged with a ring gear 86 or a second gear of the gear train 66 which, in turn, is coupled for co-rotation with the drive shaft 22 (FIG. 2). As such, the drive shaft 22 is oriented substantially normal to the anvil 62.

With reference to FIGS. 2 and 3, the transmission output shaft 50 includes two V-shaped cam grooves 90 equally spaced from each other about the outer periphery of the shaft 50. Each of the cam grooves 90 includes two segments that are inclined relative to the axis 18 in opposite directions. The hammer 58 has two cam grooves 94 (FIG. 2) equally spaced from each other about an inner periphery of the hammer 58. Like the cam grooves 90 in the transmission output shaft 50, each of the cam grooves 94 is inclined relative to the axis 18. The respective pairs of cam grooves 90, 94 in the transmission output shaft 50 and the hammer 58 are in facing relationship such that a cam member 96 (e.g., a ball) is received within each of the pairs of cam grooves 90, 94. The balls and the cam grooves 90, 94 effectively provide a cam arrangement between the transmission output shaft 50 and the hammer 58 for transferring torque between the transmission output shaft 50 and the hammer 58 between consecutive impacts of the lugs 82 upon the corresponding lugs 78 on the anvil 62. The impact mechanism 30 also includes a compression spring 98 (FIGS. 2 and 3) positioned between the hammer 58 and the carrier 54 to bias the hammer 58 toward the anvil 62. A thrust bearing 102 is positioned between the hammer 58 and the spring 98 to permit relative rotation between the spring 98 and the hammer 58.

With reference to FIG. 3, the impact tool 10 further includes a locking mechanism 106 operable to selectively lock the anvil 62 and the drive shaft 22 relative to the housing 14. Particularly, the locking mechanism 106 is toggled between a locked configuration in which the anvil 62 is prevented from rotating relative to the housing 14, and an unlocked configuration in which the anvil 62 is rotatable relative to the housing 14 in response to activation of the motor 16. As a result, the impact tool 10 may be used as a non-powered torque wrench when the anvil 62 and the drive shaft 22 are rotationally locked to the housing 14.

The locking mechanism 106 includes a locking member 110 movable between a first position in which the locking member 110 is engaged with the anvil 62 (FIGS. 3-6) and a second position in which the locking member 110 is disengaged from the anvil 62. In the illustrated embodiment of the locking mechanism 106, the locking member 110 is rotationally secured to the housing 14 such that it is only axially movable between the first and second positions. Particularly, the housing 14 defines a guide channel 114 (FIG. 3) in which the locking member 110 is axially slidable but prevented from rotating about the first axis 18. Alternatively, the locking member 110 may be axially constrained, yet pivotable or rotatable between the first and second positions. As a further alternative, movement of the locking member 110 between the first and second positions may include components of axial and rotational movement.

Figure 6:
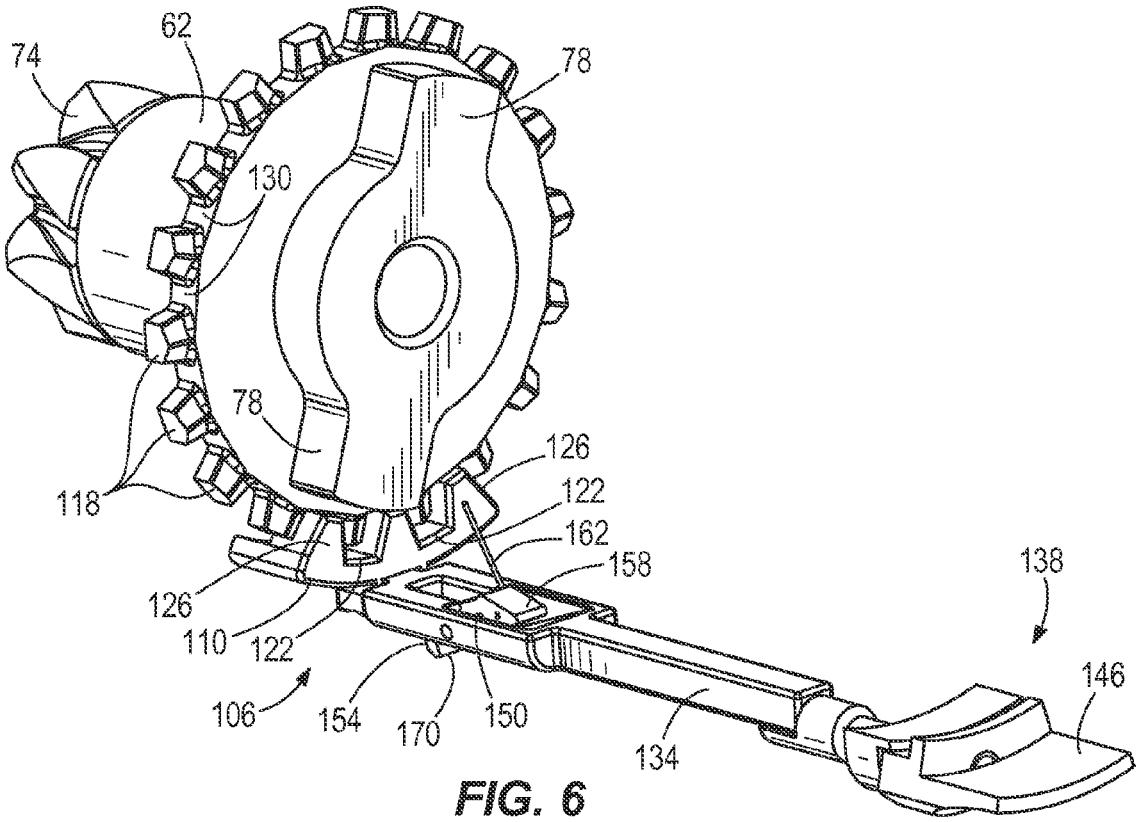
FIG. 6 is a rear perspective view of the anvil and the locking mechanism of the impact tool of FIG. 4.

With reference to FIG. 6, the locking mechanism 106 includes radially outwardly extending projections 118 coupled to an outer peripheral surface of the anvil 62 and multiple recesses 122 defined in the locking member 110 in which a corresponding number of projections 118 are receivable when the locking member 110 is in the first position. In the illustrated embodiment of the locking mechanism 106, the locking member 110 includes three radially inwardly extending projections 126, with each recess 122 being defined by two adjacent projections 126. Likewise, adjacent projections 118 on the anvil 62 define therebetween a recess 130 in which one of the projections 126 on the locking member 110 may be received (FIG. 6). Each of the recesses 122 on the locking member 110 has a width to accommodate one of the projections 118 on the anvil 62 with minimal clearance between the projections 118 and the corresponding recesses 122. As such, when the locking mechanism 106 assumes the locked configuration, the anvil 62 is rotationally locked or prevented from any substantial amount of rotation relative to the locking member 110 and the housing 14.

With continued reference to FIG. 6, the locking member 110 includes an arcuate shape such that the projections 126 extend radially inwardly toward the first axis 18. Alternatively, the locking member 110 may include only a single projection 126 that is receivable in one of the recesses 130 in the anvil 62 for rotationally locking the anvil 62 relative to the housing 14.

The locking mechanism 106 also includes a shaft 134 oriented parallel to the first axis 18 and interconnected with the locking member 110 for axial movement with the locking member 110 (FIGS. 3-6). The locking mechanism 106 further includes an actuator 138 coupled to the shaft 134 and accessible outside the housing 14 for moving the locking member 110 from the second position to the first position, and a resilient member (e.g., a compression spring 142) biasing the locking member 110 toward the second position (FIGS. 3-5). In the illustrated embodiment of the locking mechanism 106, the actuator 138 is a button 146 that is axially slidable in response to being depressed by a user of the impact tool 10 for shifting the locking member 110 from the second position, in which it is disengaged from the anvil 62, to the first position, in which it is engaged with the anvil 62 against the bias of the spring 142. Alternatively, the actuator 138 may be configured to undergo a different type of movement (e.g., pivoting, rotation, etc.) in response to being depressed.

With reference to FIGS. 3 and 6, the locking mechanism 106 also includes a pawl 150 supported by the shaft 134 and engageable with the housing 14 to maintain the locking member 110 in the first position. Particularly, the pawl 150 is pivotably coupled to the shaft 134 and includes first and second ends 154, 158. A torsion spring 162 exerts a biasing force on the pawl 150 to pivot the pawl 150 toward the orientation shown in FIG. 6 in which the first end 154 of the pawl 150 is maintained in close facing relationship with an inner periphery of the housing 14. As shown in FIG. 3, the housing 14 includes a slot or an aperture 166 in which the first end 154 of the pawl 150 is received when the locking member 110 is shifted to the first position. In the illustrated embodiment of the locking mechanism 106, a hook 170 is defined on the first end 154 of the pawl 150 for grasping an edge of the slot or aperture 166 to maintain the locking member 110 in the first position after it is shifted to the first position. Alternatively, the first end 154 of the pawl 150 may be configured in any of a number of different ways for grasping the edge of the slot or aperture 166 to maintain the locking member 110 in the first position.

With reference to FIGS. 3-5, the hammer 58 includes a circumferential lip 174 on an outer peripheral surface thereof. The circumferential lip 174 is engageable with the second end 158 of the pawl 150 to disengage the pawl 150 from the housing 14 in response to axial movement of the hammer 58 away from the anvil 62. Particularly, the lip 174 is engageable with the second end 158 of the pawl 150, thereby causing the pawl 150 to pivot and remove the hook 170 from the slot or aperture 166, in response to the cam arrangement between the transmission output shaft 50 and the hammer 58 axially displacing the hammer 58 rearward and away from the anvil 62 shortly after activation of the motor 16.

In operation of the impact tool 10, the motor support portion 38 is grasped by the user of the tool 10 during operation. During operation, the motor 16 rotates the drive shaft 22, through the transmission 34, the impact mechanism 38, and the gear train 66, in response to actuation of the trigger switch. The hammer 58 initially co-rotates with the transmission output shaft 50 and upon the first impact between the respective lugs 78, 82 of the anvil 62 and hammer 58, the anvil 62 and the drive shaft 22 are rotated at least an incremental amount provided the reaction torque on the drive shaft 22 is less than a predetermined amount that would otherwise cause the drive shaft 22 to seize. However, should the reaction torque on the drive shaft 22 exceed the predetermined amount, the drive shaft 22 and anvil 62 would seize, causing the hammer 58 to momentarily cease rotation relative to the housing 14 due to the inter-engagement of the respective lugs 78, 82 on the anvil 62 and hammer 58. The transmission output shaft 50, however, continues to be rotated by the motor 16. Continued relative rotation between the hammer 58 and the transmission output shaft 50 causes the hammer 58 to displace axially away from the anvil 62 against the bias of the spring 98 in accordance with the geometry of the cam grooves 90, 94 within the respective transmission output shaft 50 and the hammer 58.

As the hammer 58 is axially displaced relative to the transmission output shaft 50, the hammer lugs 82 are also displaced relative to the anvil 62 until the hammer lugs 82 are clear of the anvil lugs 78. At this moment, the compressed spring 98 rebounds, thereby axially displacing the hammer 58 toward the anvil 62 and rotationally accelerating the hammer 58 relative to the transmission output shaft 50 as the balls move within the pairs of cam grooves 90, 94 back toward their pre-impact position. The hammer 58 reaches a peak rotational speed, then the next impact occurs between the hammer 58 and the anvil 62. In this manner, a fastener may be driven by a tool bit, socket, and/or driver bit attached to the drive shaft 22 relative to a workpiece in incremental amounts until the fastener is sufficiently tight or loosened relative to the workpiece.

Should the user of the impact tool 10 decide to use the tool 10 as a non-powered torque wrench to apply additional torque to the fastener to either tighten or loosen the fastener, the user may depress the button 146, causing the shaft 134 and the locking member 110 to slide forwardly against the bias of the spring 142. The user depresses the button 146 until the locking member 110 assumes its first position in which at least some of the projections 118 on the anvil 62 are received within the recesses 122 of the locking member 110 and the hook 170 on the pawl 150 is biased into the slot or aperture 166 in the housing 14 by the torsion spring 162 (FIG. 3). Upon the hook 170 latching to the housing 14 in this manner, the locking member 110 is maintained in the position shown in FIG. 3 for locking the anvil 62, and therefore the drive shaft 22, relative to the housing 14. The user of the impact tool 10 may then use the motor support portion 38 of the housing 14 as a lever for manually rotating the impact tool 10 relative to the workpiece for further tightening or loosening of the fastener.

Should the user of the impact tool 10 decide to switch the tool 10 back to a powered impact driver, the user needs only to activate the motor 16 by actuating the trigger switch, thereby rotating the hammer 58 in the previously described manner until the lugs 78, 82 of the anvil 62 and the hammer 58, respectively, engage each other, after which time the hammer 58 reciprocates rearward against the bias of the compression spring 98. The circumferential lip 174 on the hammer 58 then trips or engages the second end 158 of the pawl 150, causing the pawl 150 to pivot in a clockwise direction from the frame of reference of FIG. 3 and remove the hook 170 from the slot or aperture 166 in the housing 14. The spring 142 then pushes the locking member 110 rearward to disengage the anvil 62. The anvil 62 is then free to rotate relative to the housing 14 to resume usage of the tool 10 as an impact driver.

Figure 7:
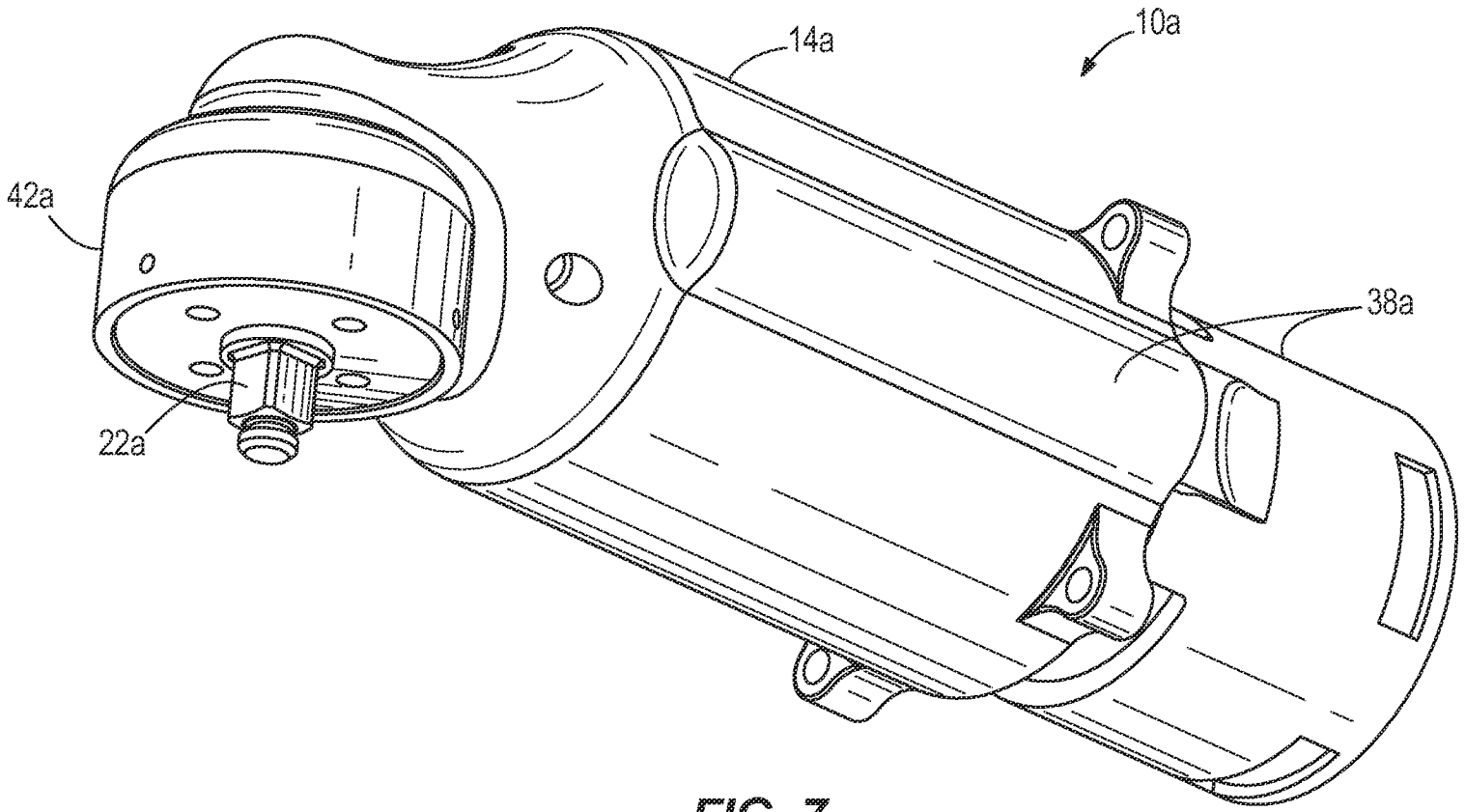
FIG. 7 is a front perspective view of an impact tool in accordance with another embodiment of the invention.

FIG. 7 illustrates an impact tool **10*a* in accordance with another embodiment of the invention. The impact tool 10*a* is otherwise identical to the impact tool 10 shown in FIGS. 1-3, with like features being shown with like reference numerals with the letter "a." The impact tool 10*a* includes an anvil 210, a hammer 58*a*, and ratcheting mechanism 214. As is described in further detail below, the ratcheting mechanism 214 is toggled between a first configuration in which the anvil 210 is prevented from rotating relative to the housing 14*a* in a first direction, and a second configuration in which the anvil 210 is prevented from rotating relative to the housing 14*a* in a second direction. Because the drive shaft 22*a* is continuously meshed with the anvil 210, the impact tool 10*a* may be used as a non-powered torque wrench to apply additional torque to a fastener to either tighten or loosen the fastener in a similar manner as the impact tool 10 of FIGS. 1-3, depending upon which of the first and second configurations the ratcheting mechanism 214** is chosen.

The ratcheting mechanism 214 includes first (FIG. 8) and second (FIG. 9) pawls 218, 222 movably coupled to the anvil 210 and ratchet teeth 226 (FIGS. 10 and 11) defined on an inner periphery of the bushing **70*a* with which the first and second pawls 218, 222 are engageable. The bushing 70*a* is affixed to the housing 14*a* such that rotation of the bushing 70*a* relative to the housing 14*a* is prevented. The pawls 218, 222 are separately movable between an extended position (FIG. 8) in which the pawls 218, 222 are engageable with the ratchet teeth 226, and a retracted position (FIG. 9) in which the pawls 218, 222 are disengaged from the ratchet teeth 226. In the illustrated embodiment of FIGS. 8 and 9, the pawls 218, 222 are pivotably coupled to the anvil 210 and are each biased toward the extended position by a resilient member (e.g., a compression spring 230; FIG. 11). Alternatively, the pawls 218, 222 may be movably coupled to the anvil 210 in any of a number of different manners for selectively engaging the ratchet teeth 226. As a further alternative, the pawls 218, 222 may be movably coupled to the housing 14*a* for deployment between extended and retracted positions, and the ratchet teeth 226 may be defined on the anvil 210**.

Figure 8:
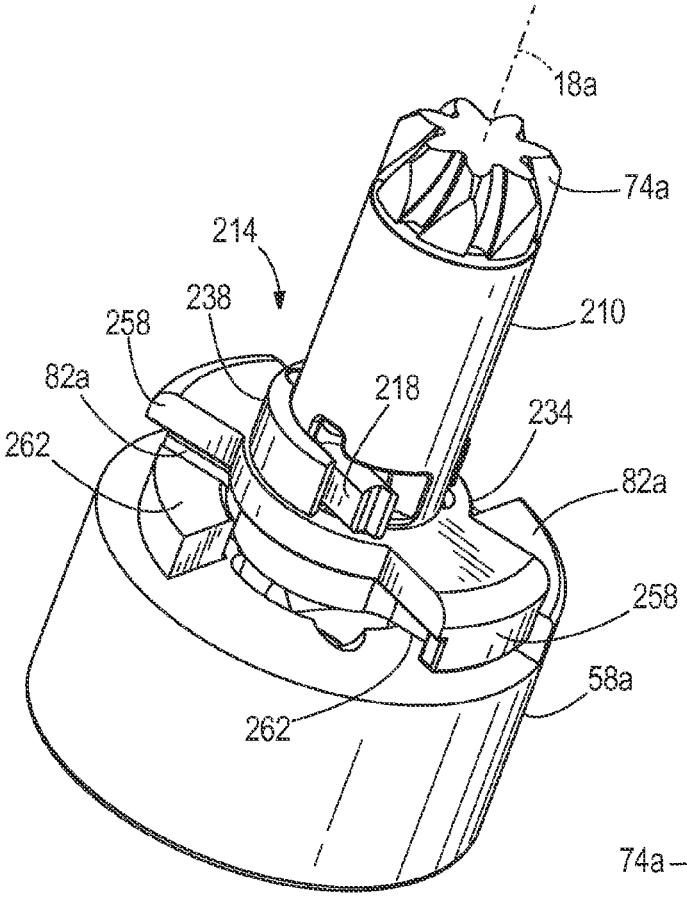
FIG. 8 is a front perspective view of an anvil, a hammer, and a ratcheting mechanism for preventing rotation of the anvil in a selected direction relative to a housing of the impact tool of FIG. 7.
Figure 9:
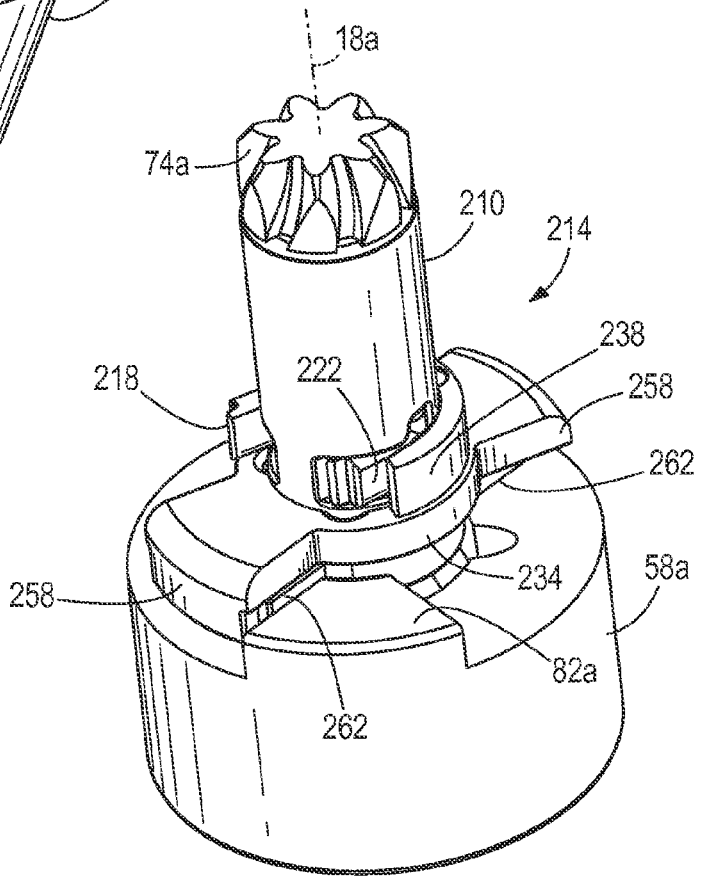
FIG. 9 is another front perspective view of the anvil, hammer, and ratcheting mechanism of FIG. 8.
Figure 10:
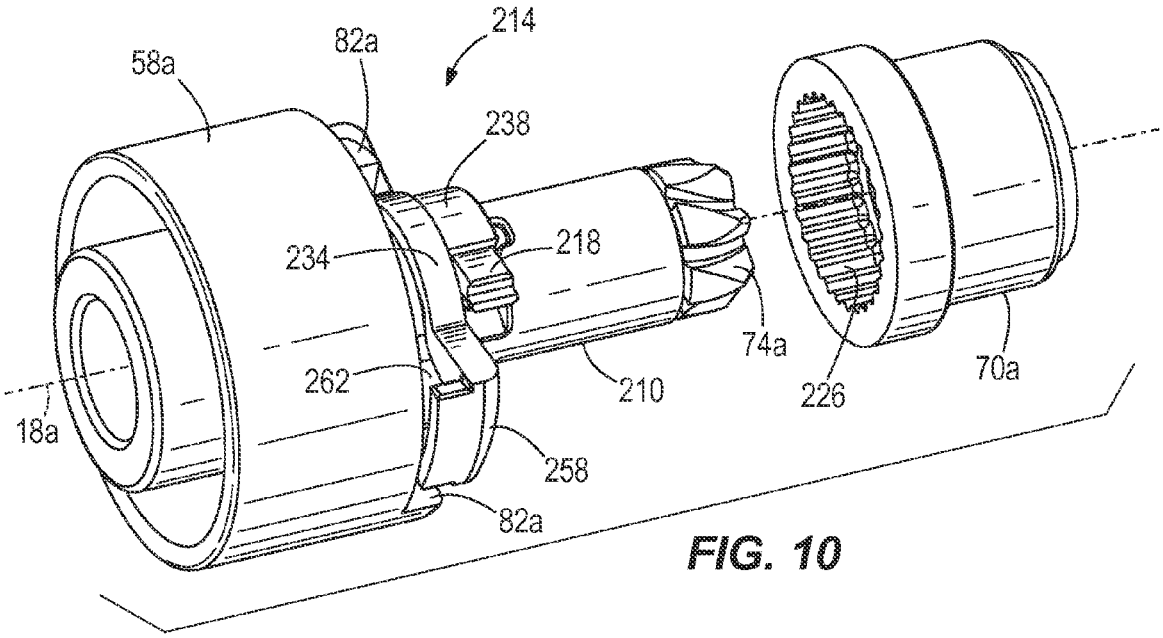
FIG. 10 is a rear perspective view of the anvil, hammer, and ratcheting mechanism of FIGS. 8 and 9, with a portion of the ratcheting mechanism shown exploded from the anvil.
Figure 11:
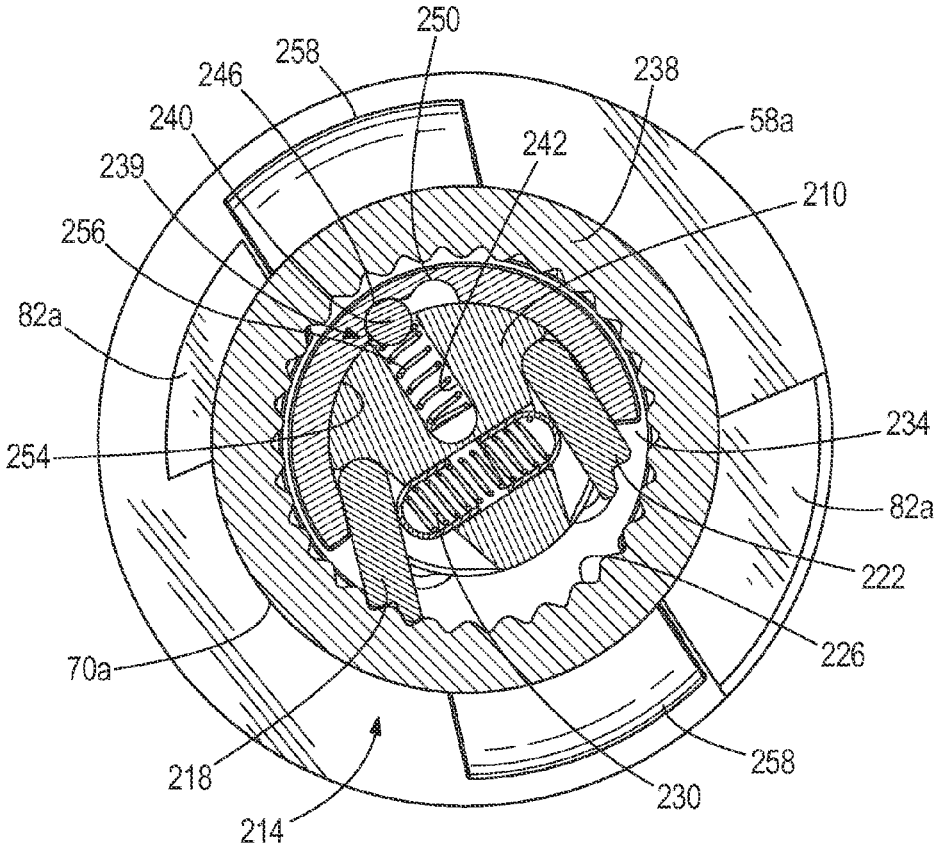
FIG. 11 is an assembled cross-sectional view through the anvil, hammer, and ratcheting mechanism of FIG. 10.

With reference to FIGS. 8-10, the ratcheting mechanism 214 also includes a switching member 234 operable to move the first pawl 218 from the extended position to the retracted position while simultaneously moving the second pawl 222 from the refracted position to the extended position, thereby toggling the ratcheting mechanism 214 from the first configuration to the second configuration. Likewise, the switching member 234 is operable to move the first pawl 218 from the retracted position to the extended position while simultaneously moving the second pawl 222 from the extended position to the retracted position, thereby toggling the ratcheting mechanism 214 from the second configuration to the first configuration. In the illustrated embodiment of the ratcheting mechanism 214, the switching member 234 includes an arcuate wall 238 surrounding at least about 180 degrees of the outer periphery of the anvil 210 (FIG. 11). When in the first configuration of the ratcheting mechanism 214, the arcuate wall 238 engages the second pawl 222 and overlies at least a portion of the second pawl 222 to maintain the second pawl 222 in its retracted position. The first pawl 218, therefore, is substantially uncovered by the arcuate wall 238 to permit the spring 230 to bias the first pawl 218 outwardly toward its extended position. Likewise, when in the second configuration of the ratcheting mechanism 214 (not shown), the arcuate wall 238 engages the first pawl 218 and overlies at least a portion of the first pawl 218 to maintain the first pawl 218 in its retracted position. The second pawl 222, therefore, is substantially uncovered by the arcuate wall 238 to permit the spring 230 to bias the second pawl 222 outwardly toward its extended position. Alternatively, the switching member 234 may include different structure for moving the first and second pawls 218, 222 between their respective extended and retracted positions.

The impact tool 10*a* further includes a detent mechanism 239 operable to maintain the ratcheting mechanism 214 alternately in the first and second configurations. Particularly, the detent mechanism 239 includes a detent member 240 (e.g., a ball) supported within a radial bore 242 in the anvil 210 (FIG. 11), first and second spaced recesses 246, 250 defined in an inner peripheral surface 254 of the arcuate wall 238, and a resilient member 256 biasing the detent member 240 toward one of the recesses 246, 250 for maintaining the ratcheting mechanism 214 in one of the first and second configurations, respectively. Accordingly, the switching member 234 is incrementally rotated about the axis 18*a* relative to the anvil 210, between first and second orientations correlating with the first and second configurations of the ratcheting mechanism 214, by an amount corresponding with the angular spacing between the recesses 246, 250. FIGS. 8-11 illustrate the switching member 234 in its first orientation relative to the anvil 210.

With reference to FIGS. 8 and 9, the switching member 234 includes opposed, radially outwardly extending lugs 258 that at least partially axially overlap respective opposed, radially outwardly extending lugs 262 on the anvil 210. A width of the switching member lugs 258, however, is greater than a width of the anvil lugs 262 by an amount corresponding with the angular spacing between the recesses 246, 250 in the arcuate wall 238. As such, when the ratcheting mechanism 214 transitions from the second configuration to the first configuration, the hammer lugs 82*a* engage only the respective lugs 258 on the switching member 234 for incrementally rotating the switching member 234 from the second orientation to the first orientation relative to the anvil 210. During the transition, the anvil 210 remains substantially stationary, although some rotation of the anvil 210 may occur so long as relative rotation between the switching member 234 and the anvil 210 occurs. As the switching member 234 assumes the first orientation (FIGS. 8 and 9), the detent member 240 is received within the first recess 246 (FIG. 11), and the hammer lugs 82*a* engage both the switching member and anvil lugs 258, 262 at the same time to co-rotate the anvil 210 and the switching member 234 as a unit about the axis 18*a* (e.g., in a counter-clockwise direction viewing along the axis 18*a* from a location behind the hammer 58*a*).

Likewise, when the ratcheting mechanism 214 transitions from the first configuration to the second configuration, the hammer lugs 82*a* engage only the respective lugs 258 on the switching member 234 for incrementally rotating the switching member 234 from the first orientation to the second orientation relative to the anvil 210. During the transition, the anvil 210 remains substantially stationary, although some rotation of the anvil 210 may occur so long as relative rotation between the switching member 234 and the anvil 210 occurs. As the switching member 234 assumes the second orientation (not shown), the detent member 240 is received within the second recess 250, and the hammer lugs 82*a* engage both the switching member and anvil lugs 258, 262 at the same time to co-rotate the anvil 210 and the switching member 234 as a unit about the axis 18*a* (e.g., in a clockwise direction viewing along the axis 18*a* from a location behind the hammer 58*a*). Therefore, to toggle the ratcheting mechanism 214 between the first and second configurations, the user of the impact tool 10*a* needs only to reverse the rotational direction of the hammer 58*a* (i.e., by reversing the rotational direction of the motor).

During powered operation of the impact tool 10*a* when driving the anvil 210 in a counter-clockwise direction (i.e., viewing along the axis 18*a* from a location behind the hammer 58*a*) for loosening fasteners, the first pawl 218 is deployed to its extended position as shown in FIG. 8 and the hammer lugs 82*a* engage the respective switching member and anvil lugs 258, 262 for co-rotating the anvil 210 and the switching member 234 as a unit. The anvil 210 is freely rotatable relative to the housing 14*a* in this direction when the ratcheting mechanism 214 is in the first configuration. Such free rotation of the anvil 210 is accompanied by reciprocating, pivotal deflection of the first pawl 218 moving over the ratchet teeth 226 on the bushing 70*a*, indicated by the "clicking" between the first pawl 218 and the bushing 70*a*.

Should the user of the impact tool 10*a* decide to use the tool 10*a* as a non-powered torque wrench to apply additional torque to a fastener to loosen the fastener, the user of the impact tool 10*a* may grasp the motor support portion 38*a* of the housing 14*a* as a lever for manually rotating the impact tool 10*a* relative to the workpiece for further loosening the fastener. Particularly, the user of the impact tool 10*a* would rotate the housing 14*a*, and therefore the bushing 70*a*, in a counter-clockwise direction (i.e., viewing along the axis 18*a* from a location behind the hammer 58*a*; FIG. 10). The first pawl 218 cannot deflect over the ratchet teeth 226 when attempting to rotate the bushing 70*a* relative to the anvil 210 in this direction. Rather, the first pawl 218 jams against the ratchet teeth 226 on the bushing 70*a* for rotationally locking the anvil 210 to the housing 14*a*, allowing the user to apply leverage to the motor support portion 38*a* of the housing 14*a* for manually rotating the impact tool 10*a* in a counter-clockwise direction for loosening a fastener. Should the user of the impact tool 10*a* decide to resume using the tool 10*a* as a powered impact driver, the user needs only to activate the motor by depressing the trigger switch.

During powered operation of the impact tool 10*a* when driving the anvil 210 in a clockwise direction (i.e., viewing along the axis 18*a* from a location behind the hammer 58*a*)

for tightening fasteners, the second pawl 222 is deployed to its extended position and the hammer lugs 82*a* engage the respective switching member and anvil lugs 258, 262 for co-rotating the anvil 210 and the switching member 234 as a unit. The anvil 210 is freely rotatable relative to the housing 14*a* in this direction when the ratcheting mechanism 214 is in the second configuration. Such free rotation of the anvil 210 is accompanied by reciprocating, pivotal deflection of the second pawl 222 moving over the ratchet teeth 226 on the bushing 70*a*, indicated by the "clicking" between the second pawl 222 and the bushing 70*a*.

Should the user of the impact tool 10*a* decide to use the tool 10*a* as a non-powered torque wrench to apply additional torque to a fastener to tighten the fastener, the user of the impact tool 10*a* may grasp the motor support portion 38*a* of the housing 14*a* as a lever for manually rotating the impact tool 10*a* relative to the workpiece for further tightening the fastener. Particularly, the user of the impact tool 10*a* would rotate the housing 14*a*, and therefore the bushing 70*a*, in a clockwise direction (i.e., viewing along the axis 18*a* from a location behind the hammer 58*a*). The second pawl 222 cannot deflect over the ratchet teeth 226 when attempting to rotate the bushing 70*a* relative to the anvil 210 in this direction. Rather, the second pawl 222 jams against the ratchet teeth 226 on the bushing 70*a* for rotationally locking the anvil 210 to the housing 14*a*, allowing the user to apply leverage to the motor support portion 38*a* of the housing 14*a* for manually rotating the impact tool 10*a* in a clockwise direction for tightening a fastener. Should the user of the impact tool 10*a* decide to resume using the tool 10*a* as a powered impact driver, the user needs only to activate the motor by depressing the trigger switch.

Various features of the invention are set forth in the following claims.

What is claimed is:

1. An impact tool comprising:

a housing;

a motor having an output shaft defining a first axis;

a drive shaft rotatably supported by the housing about a second axis oriented substantially normal to the first axis;

an impact mechanism coupled between the motor and the drive shaft and operable to impart a striking rotational force to the drive shaft, the impact mechanism including an anvil rotatably supported by the housing and coupled to the drive shaft, and a hammer coupled to the motor to receive torque from the motor and impart the striking rotational force to the anvil; and a ratcheting mechanism operable to prevent rotation of the anvil and the drive shaft in a selected direction relative to the housing, wherein the ratcheting mechanism includes first and second pawls movably coupled to one of the anvil and the housing, and ratchet teeth defined on the other of the anvil and the housing with which the first and second pawls are engageable.

2. The impact tool of claim 1, wherein the ratcheting mechanism is toggled between a first configuration in which the anvil is prevented from rotating relative to the housing in a first direction, and a second configuration in which the anvil is prevented from rotating relative to the housing in a second direction.

3. The impact tool of claim 2, wherein the ratcheting mechanism is toggled from the first configuration to the second configuration in response to reversing a rotational direction of the hammer relative to the housing.

4. The impact tool of claim 2, wherein the anvil is freely rotatable relative to the housing in the second direction when the ratcheting mechanism is in the first configuration, and wherein the anvil is freely rotatable relative to the housing in the first direction when the ratcheting mechanism is in the second configuration.

5. The impart tool of claim 4, wherein the first pawl is movable between an extended position for engaging the ratchet teeth in the first configuration of the ratchet mechanism and a retracted position, and wherein the second pawl is movable between the extended position for engaging the ratchet teeth in the second configuration of the ratchet mechanism and a retracted position.

6. The impact tool of claim 5, wherein the ratcheting mechanism includes a switching member operable to move the first pawl from the extended position to the retracted position, thereby toggling the ratcheting mechanism from the first configuration to the second configuration.

7. The impact tool of claim 6, wherein the switching member is operable to move the second pawl from the extended position to the retracted position, thereby toggling the ratcheting mechanism from the second configuration to the first configuration.

8. The impact tool of claim 6, wherein the second pawl is moved from the retracted position to the extended position in response to the first pawl being moved by the switching member from the extended position to the retracted position.

9. The impact tool of claim 6, further comprising a detent mechanism operable to maintain the ratcheting mechanism alternately in the first and second configurations.

10. The impact tool of claim 9, wherein the detent mechanism includes a detent member supported by one of the anvil and the switching member, and first and second recesses defined in the other of the anvil and the switching member in which the detent member is alternately received for maintaining the ratcheting mechanism in the first and second configurations, respectively.

11. The impact tool of claim 10, wherein the detent mechanism includes a resilient member biasing the detent member toward one of the first and second recesses.

12. The impact tool of claim 6, wherein the switching member includes a radially outwardly extending lug that at least partially axially overlaps a radially outwardly extending lug on the anvil.

13. The impact tool of claim 12, wherein the hammer includes at least one lug for intermittent impact with the anvil lug, wherein a first side of the hammer lug is engageable with a first side of each of the anvil and switching member lugs when the ratcheting mechanism is in the first configuration.

14. The impact tool of claim 13, wherein a second side of the hammer lug is engageable with a second side of each of the anvil and switching member lugs when the ratcheting mechanism is in the second configuration.

15. The impact tool of claim 5, wherein the ratcheting mechanism includes a resilient member for biasing at least one of the first and second pawls toward their respective extended positions.

16. The impact tool of claim 1, wherein the first and second pawls are pivotably coupled to the anvil.

17. The impact tool of claim 16, further comprising a bushing in which the anvil is at least partially rotatably supported, wherein the ratchet teeth are defined on the bushing.

18. The impact tool of claim 17, wherein the bushing is affixed to the housing.

19. The impact tool of claim 1, further comprising:

a transmission shaft having a first cam groove, and a cam member at least partially received within the first cam groove and a second cam groove within the hammer, wherein the cam member imparts axial movement to the hammer relative to the transmission shaft in response to relative rotation between the transmission shaft and the hammer.

20. The impact tool of claim 1, wherein the anvil includes a first gear, and wherein the drive shaft includes a second gear engaged with the first gear for co-rotation therewith.

21. The impact tool of claim 1, wherein the housing includes a first housing portion extending along the first axis, and a second housing portion extending along the second axis.

22. The impact tool of claim 21, wherein the first housing portion is longer than the second housing portion to facilitate usage of the impact tool as a non-powered torque wrench when the anvil and the drive shaft are locked to the housing.

* * * * *